US005137148A

United States Patent [19]

Evers

[11] Patent Number: 5,137,148

[45] Date of Patent: Aug. 11, 1992

[54] CIGARETTE PACK WITH PARTLY REMOVABLE INNERFRAME

[75] Inventor: Donald H. Evers, Richmond, Va.

[73] Assignee: Philip Morris Inc., New York, N.Y.

[21] Appl. No.: 659,712

[22] Filed: Feb. 25, 1991

[51] Int. Cl.[5] ..... B65D 85/28

[52] U.S. Cl. ..... 206/271; 206/273; 206/831; 229/70

[58] Field of Search ..... 206/242, 268, 271, 273, 206/274, 831, 459; 229/70, 87.14

[56] References Cited

U.S. PATENT DOCUMENTS

| | | | |
|---|---|---|---|
| 348,924 | 9/1886 | Munson . | |
| 727,600 | 5/1903 | Doscher . | |
| 1,116,043 | 11/1914 | Elliott | 206/831 |
| 2,265,664 | 12/1941 | Markert | 229/6 |
| 2,359,679 | 10/1944 | Roehrl | 229/37 |
| 2,415,117 | 2/1947 | Tamarin | 206/273 |
| 2,803,394 | 8/1957 | Ringler | 229/44 |
| 2,824,684 | 2/1958 | Ahlers | 229/44 |
| 3,018,878 | 1/1962 | Watkins | 206/41.2 |
| 3,024,902 | 3/1962 | Taylor | 206/41 |
| 3,102,675 | 9/1963 | Schrom | 229/20 |
| 3,219,253 | 11/1965 | Davis | 229/16 |
| 3,606,135 | 9/1971 | Rosenburg, Jr. | 229/37 |
| 3,625,412 | 12/1971 | Rosenburg, Jr. | 229/39 |
| 3,695,422 | 10/1972 | Tripodi | 206/831 |
| 3,924,740 | 12/1975 | Wood | 206/187 |
| 3,958,744 | 5/1976 | Herglotz | 206/831 |
| 4,042,110 | 8/1977 | Guernsey | 206/459 |
| 4,103,820 | 8/1978 | Mathison et al. | 206/831 |
| 4,216,898 | 8/1980 | Davies | 229/44 CB |
| 4,300,676 | 11/1981 | Focke et al. | 206/264 |
| 4,303,155 | 12/1981 | Focke et al. | 206/264 |
| 4,485,926 | 12/1984 | Lenzmeier | 206/831 |
| 4,732,276 | 3/1988 | Knecht | 206/624 |
| 4,742,955 | 5/1988 | Focke et al. | 229/123 |
| 4,753,383 | 6/1988 | Focke et al. | 229/160.1 |
| 4,753,384 | 6/1988 | Focke et al. | 229/160.1 |
| 4,779,733 | 10/1988 | Kilian | 206/831 |
| 4,834,240 | 5/1989 | Dagostine | 206/459 |
| 4,850,482 | 7/1989 | Campbell | 206/273 |
| 4,872,555 | 10/1989 | Shadrach, III et al. | 206/459 |
| 4,942,961 | 7/1990 | Focke et al. | 206/254 |
| 4,949,841 | 8/1990 | Focke et al. | 206/254 |
| 5,014,906 | 5/1991 | Gero | 206/273 |

FOREIGN PATENT DOCUMENTS

| | | | |
|---|---|---|---|
| 1250553 | 2/1989 | Canada . | |
| 2047860 | 4/1971 | Fed. Rep. of Germany | 206/831 |
| 4040607 | 9/1991 | Fed. Rep. of Germany . | |
| 2303720 | 10/1976 | France . | |
| 3983 | 1/1916 | United Kingdom . | |

*Primary Examiner*—David T. Fidei

*Attorney, Agent, or Firm*—Robert R. Jackson; Karen G. Horowitz

[57] ABSTRACT

A box-like cigarette pack includes an innerframe with a front wall having an initially lower portion which is folded up so that it projects into the cutout conventionally provided in the upper portion of the innerframe front wall. All or part of the folded-up portion may be made readily removable by providing a line of weakness between the removable part and the remainder of the innerframe. The folded-up portion may be printed with any desired information and may form a coupon or coupon-like article when removed. Until removed, the folded-up portion may be somewhat of an impediment to easy removal of cigarettes, thereby prompting the consumer to remove it as intended.

20 Claims, 6 Drawing Sheets

CIGARETTE PACK WITH PARTLY REMOVABLE INNERFRAME

BACKGROUND OF THE INVENTION

This invention relates to cigarette packs, and more particularly to cigarette packs in the form of boxes.

Cigarette packs in the form of boxes are extremely well known. One of the most popular forms of such boxes has an outer member which includes a lower main portion in which the cigarettes stand vertically. The upper portion is a lid which is often (although not always) hinged to the back of the main portion so that the upper ends of the cigarettes are exposed when the lid is tipped back. Such boxes typically have an innerframe inside the main portion and which extends up from the main portion under the lid to provide some interference with the lid as it opens and closes. This interference helps to keep the lid firmly and neatly closed and reduces the risk that the lid will open accidently.

Cigarette packs of the foregoing type are relatively small and strong. The visible exterior surfaces are needed for brand-identifying information, contents specifications, warning labels, etc. There is therefore no room on the outside of the pack for additional information such as promotional coupons, and even if such additional information could be put on the outside of the pack, it would be difficult for the consumer to free that information (such as a coupon) from the pack. Placing coupons or other information separately in the pack is disadvantageous because it necessitates additional processing steps and production equipment, because it may not be noticed by the consumer, because it increases production costs, etc.

It is therefore an object of this invention to provide a cigarette pack having additional surface areas which can be used for a coupon or other information.

It is another object of this invention to provide a cigarette pack including additional information area which cannot be overlooked by the consumer, but which can be easily removed and either saved or discarded as desired.

It is still another object of this invention to provide a cigarette pack having an additional but removable information area, which pack functions as a standard pack after the additional information area is removed.

SUMMARY OF THE INVENTION

These and other objects of the invention are accomplished in accordance with the principles of the invention by providing a box-like cigarette pack in which the innerframe (which may otherwise be substantially conventional) has an initially lower portion which is folded up either along the inside or the outside of the innerframe so that part of the initially lower portion extends above the normal front cutout of the innerframe where it cannot fail to be seen by the consumer when the lid of the pack is first opened. All or part of the folded-up portion of the innerframe is preferably joined to the remainder of the innerframe by a line of weakness to facilitate removal of the material beyond the line of weakness. For example, this line of weakness may be formed by perforations and/or partial scoring. In a particularly preferred embodiment, this line of weakness is also the line along which the folded-up portion is folded. The line of weakness thereby also facilitates folding the innerframe at the desired location, and the entire folded-up portion is removable by the consumer.

This provides the largest additional surface area for use as a coupon or for other information. The folded-up portion (or at least that part which is beyond the above-mentioned line of weakness) may be printed, embossed, and/or debossed on either or both sides with any desired information.

Further features of the invention, its nature and various advantages will be more apparent from the accompanying drawings and the following detailed description of the preferred embodiments.

DETAILED DESCRIPTION OF THE PREFERRED EMBODIMENTS

Figure 1:
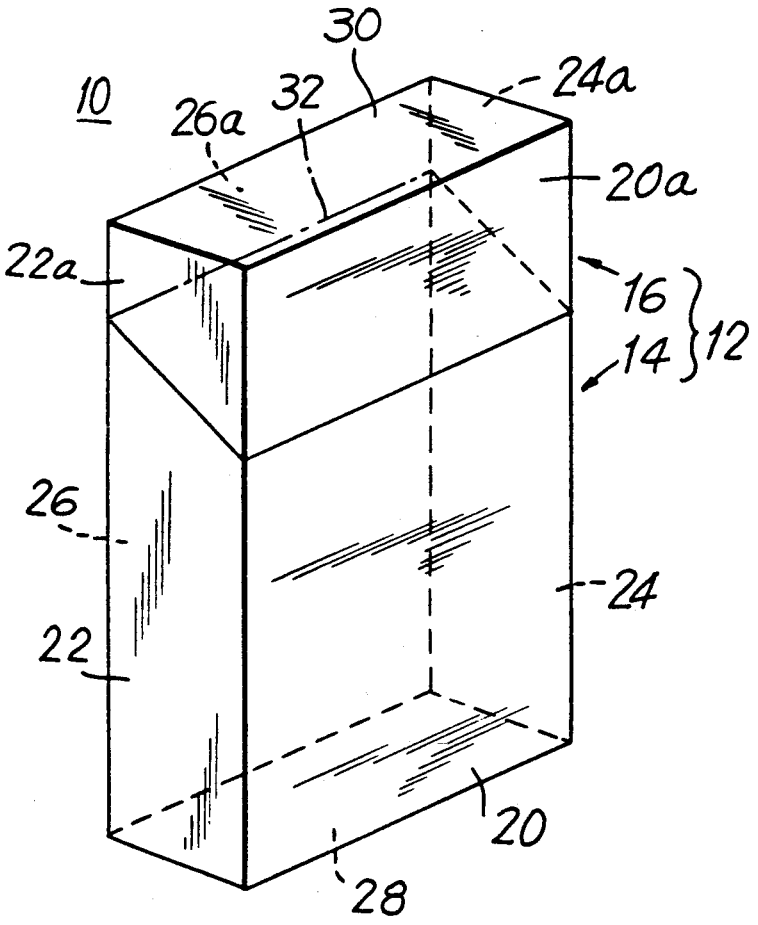
FIG. 1 PRIOR ART
FIG. 1 is an isometric view of a cigarette pack of an illustrative type with which this invention can be employed.

As shown in FIG. 1, the conventional hinged-lid, box-type cigarette pack 10 includes an outer member 12 having a lower main portion 14 and an upper lid portion 16. Main portion 14 has a front wall 20, a left side wall 22, a right side wall 24, a rear wall 26, and a bottom wall 28. Lid 16 has similar front **20*a*, left side 22*a*, right side 24*a*, and rear 26*a* walls which respectively function as continuations of the similarly named main portion walls when the lid is closed as shown in FIG. 1. In addition, lid 16 has a top wall 30. Lid 16 is typically hinged to main portion 14 along hinge line 32 where rear walls 26 and 26*a* meet one another. When lid 16 is tipped all the way back along hinge line 32, the pack has the appearance shown in FIG. 2 when viewed from the front, or as shown in FIG. 3** when viewed from the top.

Figure 2:
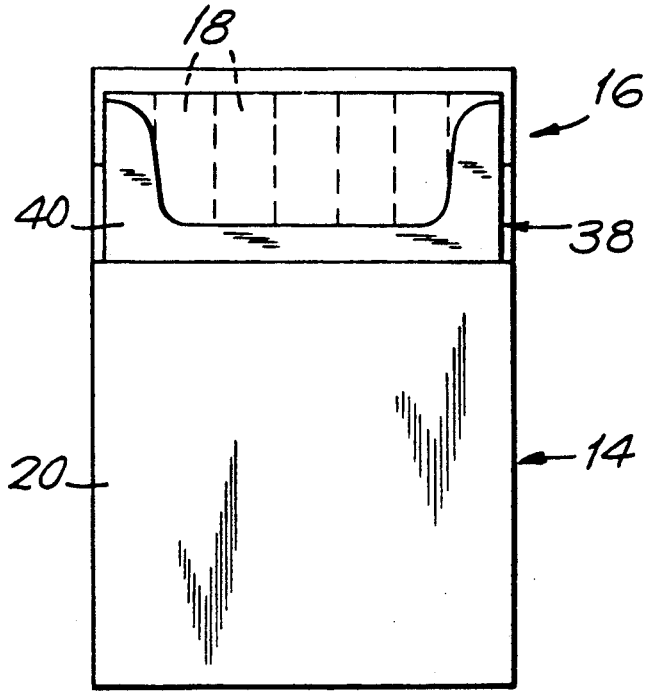
FIG. 2 PRIOR ART
FIG. 2 is a front view of the pack of FIG. 1 with the top or lid pivoted back.
Figure 3:
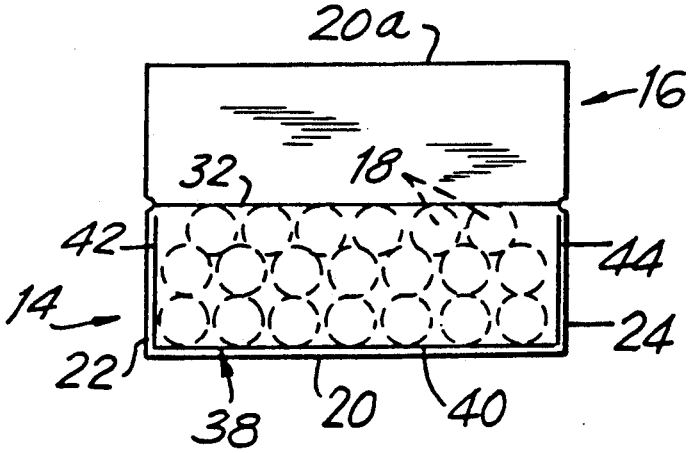
FIG. 3 PRIOR ART
FIG. 3 is a top view of the pack of FIG. 1 with the top or lid pivoted back.

FIGS. 2 and 3 reveal the innerframe 38 which is conventionally included inside at least the upper portion of main portion 14. Innerframe 38 includes a front wall 40, a left side wall 42, and a right side wall 44. The central upper portion of innerframe front wall 40 has a depression or cutout to facilitate consumer access to the upper ends of the cigarettes 18 in the pack. Typically, cigarettes 18 are initially wrapped in foil inside innerframe 38. The upper front portion of this foil wrapper may be removed by the consumer when he or she opens the pack. Innerframe 38 is typically glued to panels 22 and 24 and/or panel 20. When lid 16 is closed, it fits down over and completely covers the portion of innerframe 38 which projects above main portion 14. Innerframe 38 interferes somewhat with lid 16 as the lid is opened and closed. This interference helps to keep lid 16 neatly closed and reduces the risk of the pack opening by accident.

Figure 4:
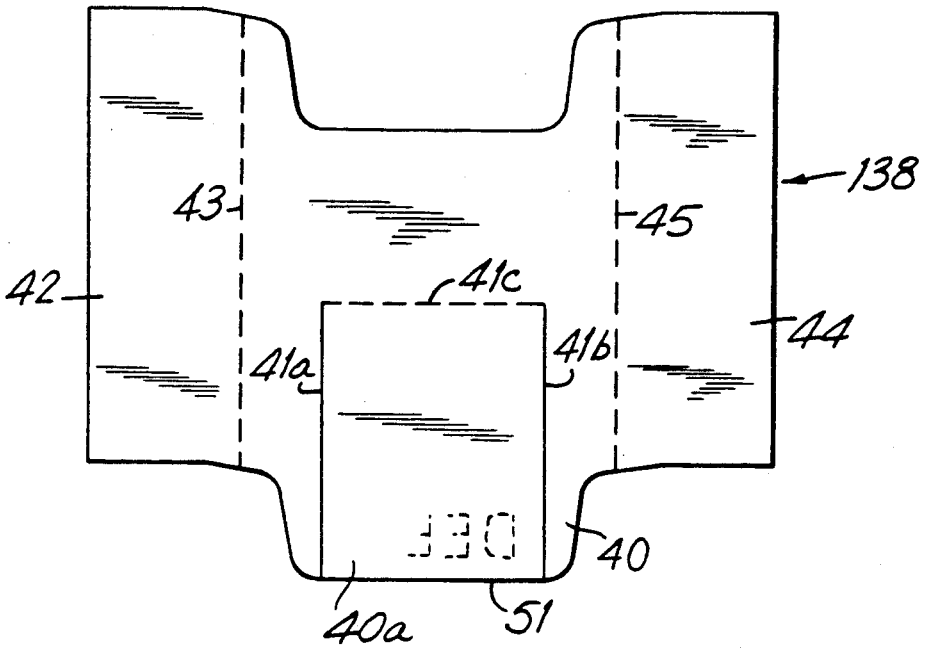
FIG. 4 is an illustrative innerframe blank configured in accordance with this invention.
Figure 5:
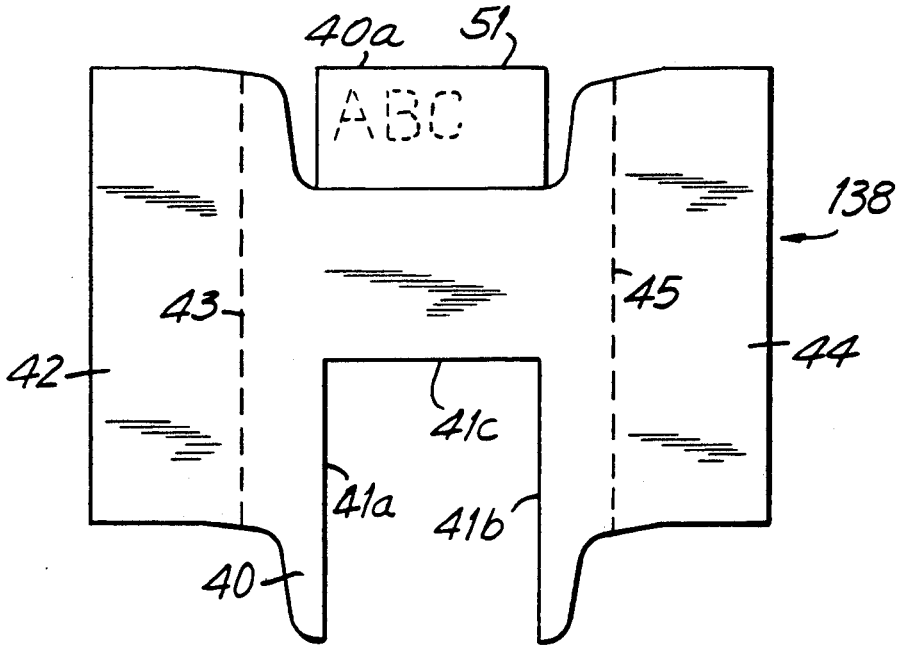
FIG. 5 shows the innerframe blank of FIG. 4 with an initially lower portion folded up along what will be the inner surface of the innerframe in the finished pack.
Figure 6:
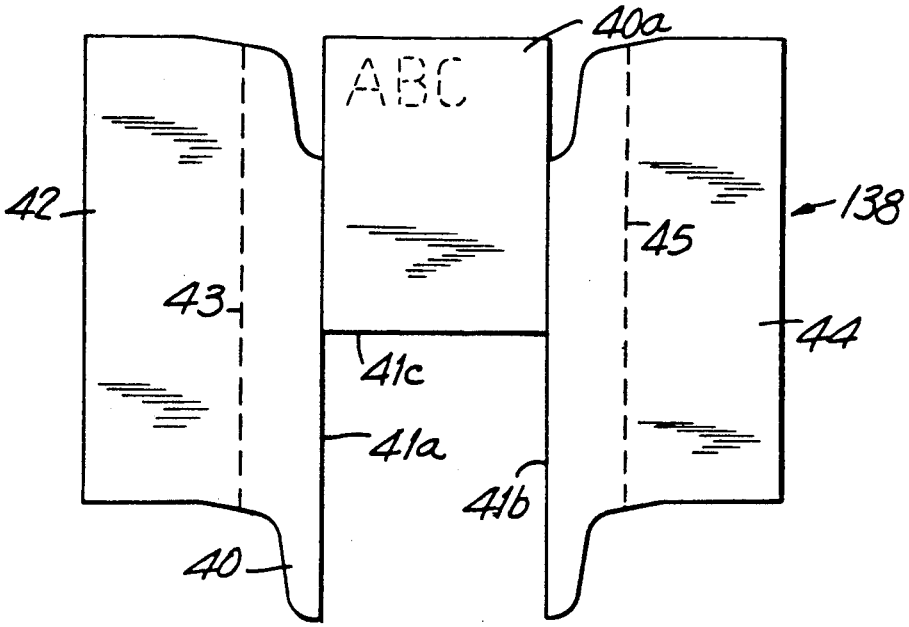
FIG. 6 shows the innerframe blank of FIG. 4 with the above-mentioned lower portion folded up along what will be the outer surface of the innerframe in the finished pack.

An illustrative innerframe blank 138 in accordance with this invention is shown in FIG. 4. Similar reference numbers are used in FIG. 4 and subsequent FIGS. for elements which are similar or related to innerframe elements described above. Innerframe blank 138 includes a front wall panel 40 having an initially lower portion 40*a*, a left wall panel 42, and a right wall panel 44. To facilitate folding panels 42 and 44, the blank may be weakened (e.g., scored and/or perforated) along lines 43 and 45. Blank 138 is also extensively weakened or preferably cut through along vertical line 41*a* and 41*b* located along each side of lower portion 40*a*. Another line of weakness 41*c* is provided in blank 138 above lower portion 40*a*. Cuts 41*a* and 41*b* and line of weakness 41*c* facilitate folding initially lower portion 40*a* up along line 41*c* as shown in FIG. 5 or 6. In FIG. 5 initially lower portion 40*a* is folded behind the remainder of blank 138. In the alternative embodiment shown in FIG. 6, on the other hand, initially lower portion 40*a* is folded up in front of the remainder of the blank. In addition, to facilitating folding along line 41*c*, the weakening of this line may be such as to facilitate removal of portion 40*a* from a finished pack by separation along line 41*a*. Alternatively, line 41*c* may be made relatively strong and another weaker line (not shown) may be provided across portion 40*a* between line 41*c* and the opposite edge 51 of that portion. In that event only the part of portion 40*a* beyond this other line of weakness is removed from the finished pack by the consumer.

As can be seen in FIG. 5 or 6, the line 41*c* along which portion 40*a* is folded up is preferably high enough so that a significant part of portions 40*a* projects above the upper edge of the front wall of main pack portion 14, and also preferably above the lower edge of the cutout conventionally provided by the top edge of the innerframe. Indeed, portion 40*a* may even extend over all or a portion of the tops of the cigarettes in the finished pack as shown, for example, in FIGS. 10 and 11 which are discussed in detail below. On the other hand, the line 41*c* along which portion 40*a* is folded up is preferably below the upper edge of the front wall of main pack portion 14 so that line 41*c* is not visible in the finished pack. In the embodiments shown in FIGS. 4–7, portion 40*a*, when folded up, extends approximately to the top of the innerframe which is at or near the upper ends of the cigarettes in the finished pack.

One or both sides of portion 40*a* may be printed, embossed, and/or debossed with any desired information as suggested by the phantom letters ABC and DEF in the FIGS. Preferably at least some of this information is visible to the consumer when the top of the pack is first opened. The then-visible information may include a suggestion that the consumer remove portion 40*a* from the pack. When that is done, additional information on portion 40*a* may become visible to the consumer. The removed portion may be a convenient size and shape for a coupon or coupon-like article. Note that by projecting up into the cutout in the top of the innerframe, portion 40*a* is not only highly visible to the consumer when the pack is opened, but the consumer is also encouraged to remove portion 40*a* by the fact that until removed it tends to interfere with the usual easy removal of cigarettes from the pack.

Printing, embossing, and/or debossing may be placed on portion 40*a* at any time (e.g., before or after the innerframes are cut to their final individual shape). A special eye mark may be included in printing applied prior to cutting to help register the cutting with the printing. It will be noted that the innerframe design shown in FIG. 4 permits continuous vertical cutoff of innerframes from a roll of material with no scrap or waste.

Figure 7:
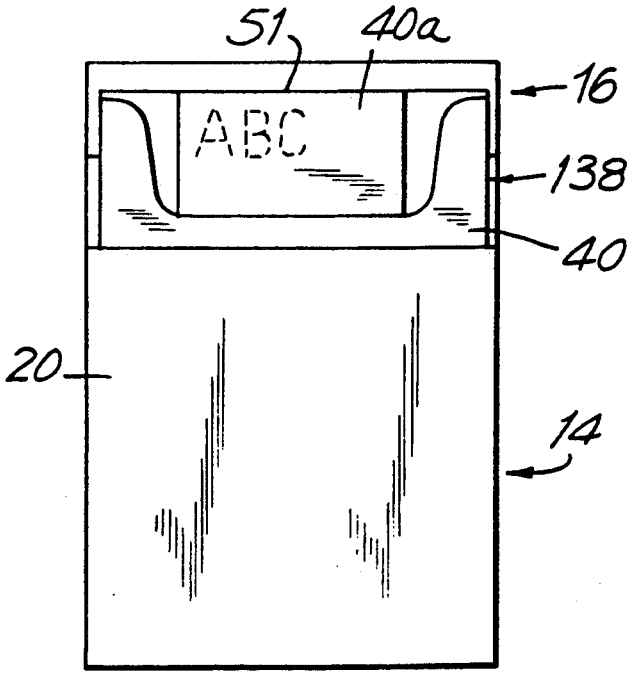
FIG. 7 is a view similar to FIG. 2 but showing a pack having an innerframe of the type shown in FIG. 4.

FIG. 7 is similar to FIG. 2 but shows a cigarette pack with an innerframe 138 in accordance with this invention prior to removal of portion 40*a*. Although in the pack shown in FIG. 7 innerframe portion 40*a* is folded up as shown in FIG. 5, it will be understood that portion 40*a* could alternatively be folded up as shown in FIG. 6 if desired. As can be seen in FIG. 7, panels 40 and 40*a* are inside and/or extend up from front wall 20. Panels 42 and 44 are respectively inside and extend up from left and right side walls 22 and 24. Panel 40*a* extends up into the innerframe cutout conventionally provided in front of the tops of the cigarettes where it is (1) clearly visible, (2) easily grasped for removal, and (3) a possible impediment to easy withdrawal of the first cigarette until removed. Innerframe 138 is preferably glued inside the main portion 14 of the pack (e.g., by gluing innerframe panels 42 and 44 to pack side walls 22 and 24, respectively). If desired, the portion of the innerframe to be removed may be glued to the foil pull tab conventionally provided on the upper portion of the foil wrapped around the cigarettes as mentioned above. The removable portion of the innerframe then comes out of the pack when the foil pull tab is pulled.

Although FIG. 7 shows the pack with top 16 open, it will be appreciated that the top opens and closes exactly as shown in FIGS. 1–3 and described above. As in the prior art, when the top of the pack shown in FIG. 7 is closed, the outer member of the pack completely encloses and obscures innerframe 138. Accordingly when the pack of FIG. 7 is closed, it looks exactly as shown in FIG. 1.

When the consumer of a pack having an innerframe of the type shown in FIG. 4 first opens the pack, he or she sees what is shown in FIG. 7. In order to most conveniently remove a cigarette from the pack, the consumer must first remove panel 40*a*. This may be made especially apparent to the consumer by printing on panel 40*a* or elsewhere on the innerframe or pack. After panel 40*a* has been removed, the pack looks exactly as shown in FIGS. 2 and 3 and is thereafter functionally the same as a conventional pack.

Although panel 40*a* is shown in the drawings as a rectangle, it will be appreciated that it can have other shapes such as a scalloped edge, a rounded edge, an arrowhead shaped edge, etc.

Figure 8:
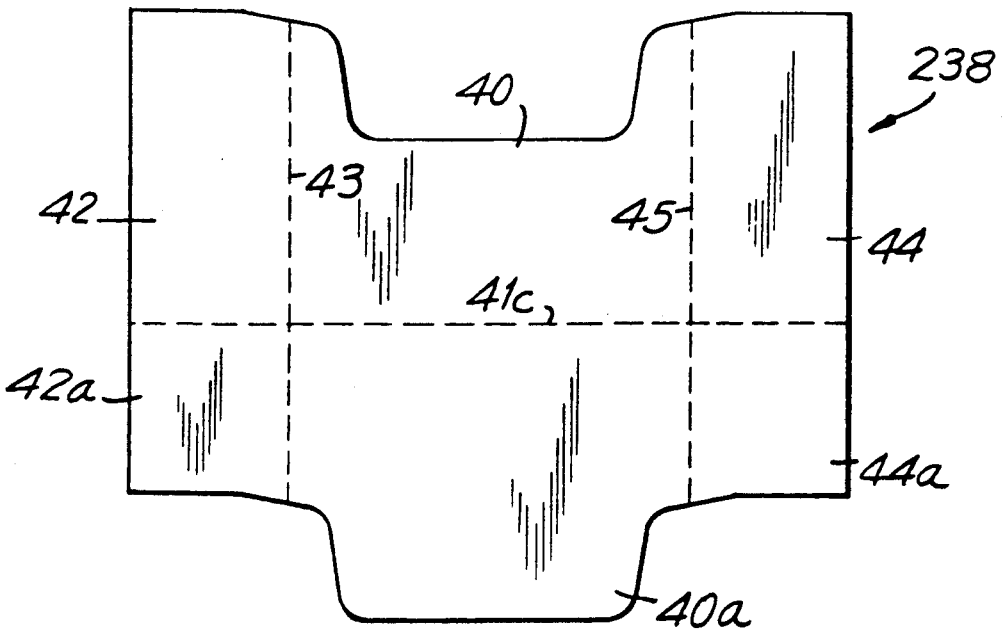
FIG. 8 is a view similar to FIG. 4 showing an alternative innerframe blank configured in accordance with this invention.
Figure 9:
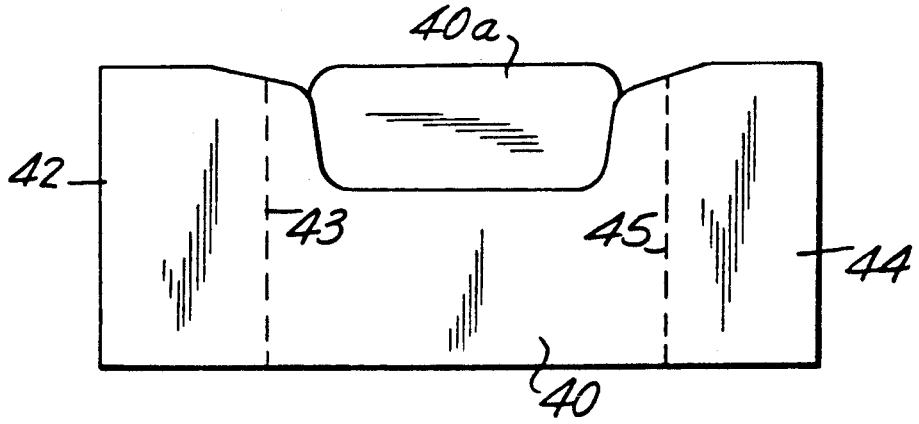
FIG. 9 is a view similar to FIG. 5 for the alterative innerframe blank of FIG. 8.

Various techniques can be employed to enlarge the removable portion of the innerframe in accordance with this invention if desired. For example, FIGS. 8 and 9 show an alternative embodiment 238 in which the line of weakness 41*c* alogn which the initially lower portion of the innerframe blank is folded up and subsequently torn out extends all the way across the blank. Cut lines 41*a* and 41*b* are not needed in this embodiment. Accordingly, the removable portion of the innerframe includes the initially lower portion 40*a* of front panel 40, as well as the initially lower portions 42*a* and 44*a* of side panels 42 and 44.

Figure 10:
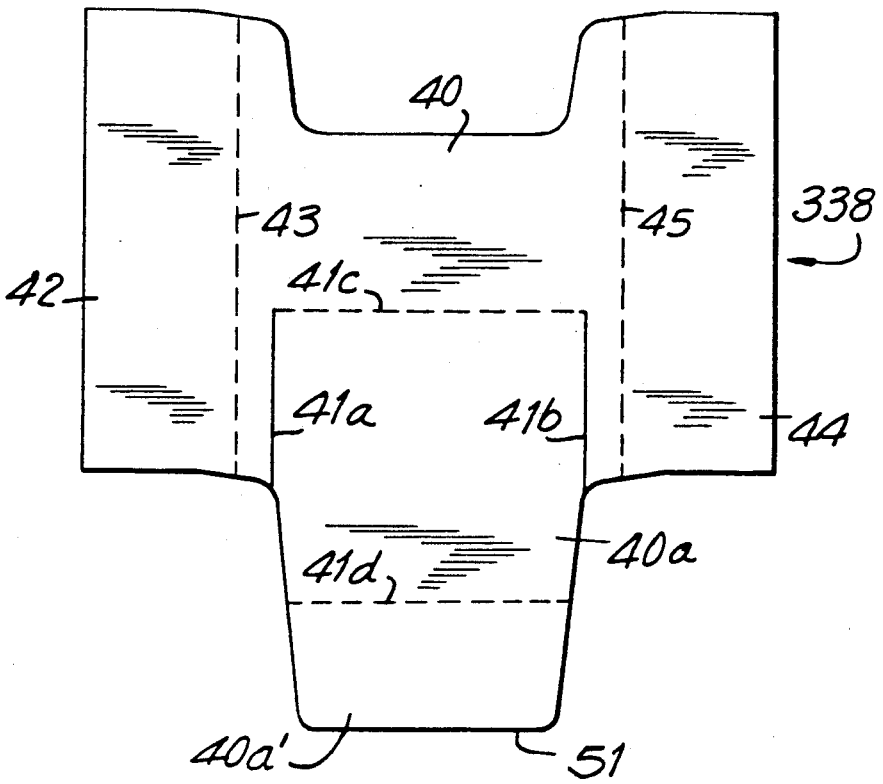
FIG. 10 is a view similar to FIG. 4 showing a further alternative innerframe blank configured in accordance with this invention.
Figure 11:
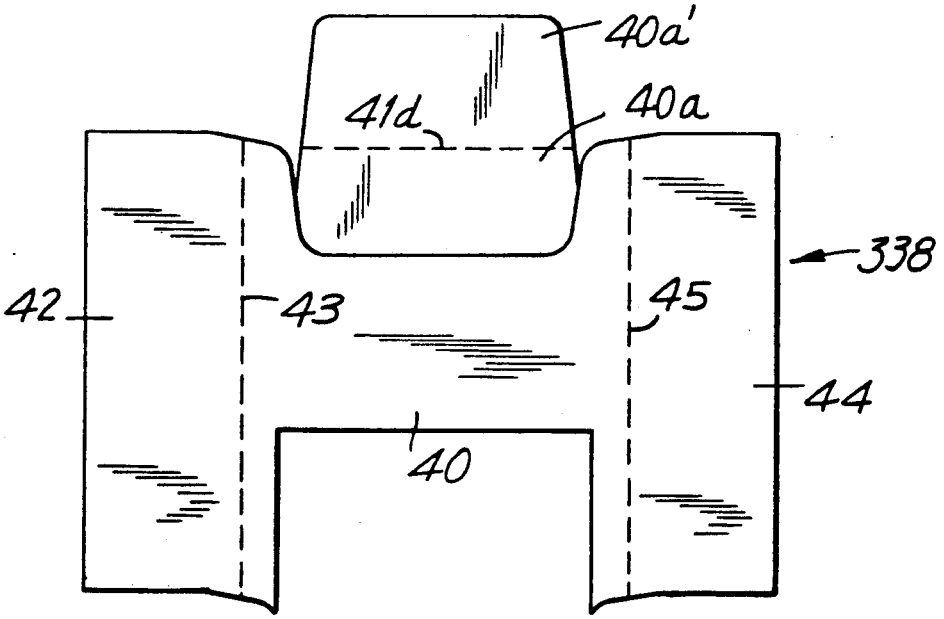
FIG. 11 is a view similar to FIG. 5 for the further alternative innerframe blank of FIG. 10.

FIGS. 10 and 11 show another alternative embodiment 338 in which the initially lower portion 40*a* of front panel 40 is large enough so that a part 40*a'* of that portion can be folded back over the tops of the cigarettes in the finished pack. Portion 40*a* can be enlarged in this manner either by extending it down (as shown in FIG. 10) or by raising fold line 41*c*. Longer cigarettes facilitate adoption of the latter alternative. The alternative shown in FIG. 10 may have the disadvantage that the upper and lower margins of the innerframe blank are not exactly complementary, so there will be some scrap innerframe material with this particular design. An additional line of weakness 41*d* is provided to facilitate folding part 40*a'* back over the tops of the cigarettes.

It will be understood that the foregoing is merely illustrative of the principles of this invention, and that various modifications can be made by those skilled in the art without departing from the scope and spirit of the invention. For example, lid 16 may be either integral with main portion 14 or glued to main portion 14 by a tab. The lid of the pack may also slide on and off over the innerframe rather than pivoting open and closed. It will also be appreciated that the principles of this invention can be applied to cigarette packs of any size (e.g., packs of 6, 10, 14, 20 (as shown in the drawings), 25, etc., cigarettes).

What is claimed is:

1. A cigarette pack for containing cigarettes having first ends adjacent a first end of said cigarette pack and second ends adjacent a second end of said cigarette pack, said cigarette pack comprising:

an outer member including a first wall having a first edge adjacent said first end of said cigarette pack and spaced from said first ends of said cigarettes in the pack and a second edge adjacent said second end of said cigarette pack; and an innerframe member including a first wall partly disposed inside said outer member first wall between said outer member first wall and said cigarettes, said innerframe first wall having a first edge adjacent said first end of said cigarette pack, a second edge adjacent said second end of said cigarette pack, and an extension extending from said second edge of said innerframe first wall and having a first edge adjacent said second edge of said innerframe first wall and a free edge, wherein said extension is folded approximately 180° along said second edge of said innerframe member first wall and said first edge of said extension, to be substantially parallel to the remainder of said innerframe member first wall, so that said free edge of said extension lies between said first ends of said cigarettes and said first edge of said outer member first wall.

2. The cigarette pack defined in claim 1 wherein said extension is folded along a line which is positioned between said first edge of said outer member first wall and said second edge of said outer member first wall.

3. The cigarette pack defined in claim 1 wherein said extension is folded to be positioned inside the remainder of said innerframe member first wall, so that said extension is positioned between said innerframe member first wall and said cigarettes.

4. The cigarette pack defined in claim 1 wherein said extension is folded to be positioned inside the remainder of said innerframe member first wall, so that said extension is positioned between said innerframe member first wall and said outer member first wall.

5. The cigarette pack defined in claim 1 wherein said first edge of said innerframe member first wall is positioned between said first edge of said outer member first wall and said first ends of said cigarettes.

6. The cigarette pack defined in claim 5 wherein said free edge of said extension extends between said first edge of said innerframe member first wall and said first ends of said cigarettes.

7. The cigarette pack defined in claim 1 wherein said extension is joined to the balance of said innerframe member along a line which has been weakened to facilitate removal of said extension from said pack.

8. The cigarette pack defined in claim 7 wherein said extension is folded along said line.

9. The cigarette pack defined in claim 7 wherein the cigarettes are wrapped in a foil wrapper inside said innerframe member such that said foil wrapper is positioned between said innerframe member and said cigarettes, said foil wrapper having a removable upper portion, and wherein said extension is secured to said upper portion.

10. The cigarette pack defined in claim 1 wherein said extension extends to approximately the tips of the first ends of the cigarettes.

11. The cigarette pack defined in claim 1 wherein said extension extends over the tips of the first ends of the cigarettes.

12. The cigarette pack defined in claim 1 wherein said extension is printed with predetermined indicia.

13. The cigarette pack defined in claim 1 further comprising:

a lid member which fits over the part of said innerframe member which is positioned between said first edge of said outer member first wall and said first ends of said cigarettes, and which closes said pack when said lid member is closed so that the cigarettes contained in said pack are inaccessible.

14. The cigarette pack defined in claim 13 wherein said lid member completely covers the part of said innerframe member which extends between said first edge of said outer member first wall and said first ends of said cigarettes when said lid member is closed.

15. The cigarette pack defined in claim 14 wherein said outer member further includes a second wall opposite and spaced from said outer member first wall, and wherein said lid member is hinged to said second wall.

16. The cigarette pack defined in claim 1 wherein said outer member further includes first and second side walls extending substantially perpendicular to said outer member first wall, and wherein said innerframe member includes first and second side panels extending substantially perpendicular to said innerframe first wall and respectively partly disposed inside said first and second side walls, such that said first and second side panels of said innerframe member are positioned between said first and second side walls of said outer member and said cigarettes.

17. The cigarette pack defined in claim 16 wherein each of said first and second side panels of said innerframe member includes an extension which is folded over said innerframe member to be substantially parallel to the remainder of said first and second side panels, respectively.

18. An assembled hinged lid cigarette package comprising:

a) a lower body portion including a first front wall, a bottom wall, a first rear wall and side walls, said first front wall having a first upper edge;

b) a lid portion disposed above said lower body portion including a second rear wall integrally hinged to said first rear wall of said lower body portion; and c) an innerframe fixed relative to said lower body portion, said innerframe including an innerframe front wall, said innerframe front wall comprising a lower wall portion, an upper wall portion and a detachable panel; wherein:

said lower wall portion is in superposed relation to at least a portion of said first front wall of said lower body portion;

said upper wall portion of said innerframe front wall includes an upper innerframe edge disposed above said first upper edge;

said detachable panel is in superposed relation to at least a portion of said upper portion of said innerframe front wall;

said detachable panel includes an upper panel portion extending above said upper innerframe edge; and said detachable panel is detachable along a break-line located below said first upper edge;

whereby said detachable panel is manually removable from said hinged lid cigarette package and said break line is concealed by said first front wall of said lower body portion.

19. The cigarette pack defined in claim 18, wherein said detachable panel is connected to said innerframe lower wall portion along a fold line.

20. The cigarette pack defined in claim 19, wherein said fold line and said break line coincide.

* * * * *